US005743434A

United States Patent [19]

Light

[11] Patent Number: 5,743,434

[45] Date of Patent: Apr. 28, 1998

[54] COLLAPSIBLE TUBE COMPRESSING DEVICE

[76] Inventor: Homer Edwin Light, R.D. #3, Box 703B, Annville, Pa. 17003

[21] Appl. No.: 660,675

[22] Filed: Jun. 5, 1996

Related U.S. Application Data

[63] Continuation-in-part of Ser. No. 573,203, Dec. 15, 1995, abandoned.

[51] Int. Cl.[6] ..... B65D 35/28

[52] U.S. Cl. ..... 222/103

[58] Field of Search ..... 222/95, 103

[56] References Cited

U.S. PATENT DOCUMENTS

| | | | |
|---|---|---|---|
| 2,148,321 | 2/1939 | Oplinger | 222/103 |
| 2,643,029 | 6/1953 | Chapman et al. | 222/103 |
| 2,790,579 | 4/1957 | Woldorf | 222/103 |
| 2,830,736 | 4/1958 | Schneider | 222/103 |
| 3,219,238 | 11/1965 | Borkenhagen | 222/103 X |
| 3,291,345 | 12/1966 | McCombs | 222/103 |
| 3,961,727 | 6/1976 | Spears | 222/103 |
| 4,365,727 | 12/1982 | Shmelkin | 222/103 X |

FOREIGN PATENT DOCUMENTS

| | | | |
|---|---|---|---|
| 124759 | 2/1949 | Sweden | 222/103 |
| 974849 | 12/1962 | United Kingdom | 222/103 |

*Primary Examiner*—Kenneth Bomberg
*Attorney, Agent, or Firm*—Arthur R. Eglington

[57] ABSTRACT

A squeezing device for dispensing flowable contents from a compressible tube comprising two planar members hinged together transversely with an axle means. The lower member is a support plate for the tube and the upper member is a pressor plate being adapted to provide a variable width transverse gap at their hinged end which is dependent upon the inclination of that member and to slidingly engage and intermittently retain the collapsible tube while its contents are being expressed uniformly from the normally capped end. The transverse support axis for the hinged members can either be a dual prong element integral of the pressor member or it can be a separable rigid rod spanning the sidewalls of both members and capped externally at each longitudinal end to be retained in place.

2 Claims, 3 Drawing Sheets

60L
L
64L
24B
68L
66L
T
70L
62T
74L
64R
66R
68R
70R
L
84L
26B
78L
86L
80L
T
82L
76T
84R
78R
86R
80R
82R 72L
62T
24M
72R 90R
76T
90L
26M 60L
68L
62T
72L
24M 74L
78L
86L
76T
90L
26M
88R
70R
72R
68R
62T/A

60L/A
68L
72L
88L
70L
90R
24M
78R
86R
76T/A 74L
78L
86L
90L
26M

COLLAPSIBLE TUBE COMPRESSING DEVICE

CROSS REFERENCE TO COLLAPSIBLE TUBE COMPRESSING DEVICE

This is a continuation in part, of my application Ser. No. 08/573,203 filed Dec. 15, 1995 now abandoned.

FIELD OF THE INVENTION

This invention relates to flowable materials dispensers, and more particularly to an improved digitally-operated device for dispensing the contents of a collapsible tube containing materials ranging from toothpaste to a caulking compound.

BACKGROUND OF THE INVENTION

It has long been recognized that unless extra care is taken in the digital squeezing out of the contents of a collapsible tube, containing a flowable and valuable material, that corrugated deformations will occur in the tube, and so trap appreciable portions of the tube contents, causing unused contents going to trash. Not infrequently, such corrugations cause tube wall fractures and spilled contents, resulting in major product wastage.

Until the present, a wide variety of instruments or devices have been offered including a housing for retaining the tube body, and a relatively complex tube-squeezing mechanism operatively combined with the housing member. Some of these are so complex that fabrication costs and durability deny them consumer acceptance. Compare McCombs U.S. Pat. No. 3,291,345 (1966); Borkenhagen U.S. Pat. No. 3,219,238 (1965); Spears U.S. Pat. No. 3,961,727 (1976) and Shmelkin U.S. Pat. No. 4,365,727 (1982). Oplinger U.S. Pat. No. 2,148,321 (1939) discloses a device having a complex pinning and pivoting assembly for effecting variable jaw action and digital tube insertion.

OBJECTS OF THE INVENTION

It is a principal object of the invention to provide an economically fabricated, hand held device for dispensing viscous pastes, or the like, from a collapsible tube, made either of a metallic sheet or of plastic film, which readily dispenses substantially all of the useful materials from the tube with simple manual compression.

It is another object of the invention to provide a squeezing-dispensing device which comprises a minimal number of sturdy parts for repetitive operation, being for all practical purposes, break-down free and of uncommon durability.

It is a still further object of the invention to provide a paste-squeezing device which presents the tube in fully viewable condition so that the user is readily aware of the extent of the remaining tube contents.

A yet further object of the invention is to provide a device which allows for uniform contents discharge, is lightweight in construction and portable, and is easy to operate, and which is amenable to low cost, high volume unit production that will lead to widespread adoption.

SUMMARY OF THE INVENTION

According to the invention, in a preferred embodiment, provided is a collapsible tube-squeezing device adapted for efficient expelling of the flowable contents of a filled tube and requiring only essentially single-hand manipulation consisting essentially of a pair of separable members normally in pivotable engagement with each other, further comprising: a first planar base member; a pair of longitudinally aligned, upstanding flanges, manually flexible, conjoined along the lateral edges of the base member defining a channel, and each flange presenting a tapered contour from one longitudinal end to the other longitudinal end; a receiving means provided in the wider area of each of said flanges to accept in pivotal relationship any transversely aligned projection extending therebetween; a second planar presser lever member which is sized to nest freely between the first pair of flanges and to reside in overlying relationship to the channel of said base member; a pair of outwardly projecting lugs are mounted proximal to the one longitudinal end of the lever member adapted to engage the receiving means, which means serves to permit the reciprocal pivoting of the lever member respecting the base member; and, the pivoting longitudinal end of the lever member being provided with a cross-section configured to provide a variable transverse gap between the two members along their adjacent pivoting peripheries, with the maximal transverse gap occurring when the lever member forms an obtuse angle up to 180° mode, and the minimal transverse gap occurring when said lever reaches a substantially vertical acute angle down to zero degrees for effecting maximum tube compression.

In another embodiment of the invention, there is provided a collapsible tube-squeezing device adapted for efficient expelling of the flowable contents and comprising: a first planar, generally rectangular rigid base member; a pair of laterally aligned, upstanding flanges, manually flexible, conjoined along opposing lateral edges of the base member defining a channel with each presenting a tapered flange from one longitudinal end to another longitudinal end; a bore hole provided in each such flange forming a first set and each hole defining the longitudinal ends of a horizontal and transverse phantom line drawn therebetween; a second planar, generally rectangular, presser lever rigid member having a similar pair of upstanding flanges, each presenting a tapered flange from one longitudinal end to another longitudinal end and sized to nest freely between the first pair of lateral flanges and to move in overlying relationship to said base member; a second set of bore holes, with one provided in each flange of the second member opposing the first set of bore holes; a pair of pivot pins positioned transversely of, and proximal to the one longitudinal end, axially aligned, and adapted to engage the opposing bore holes, such bore holes defining a transverse axis of pivoting for the lever member, serving to permit the reciprocating movement of the lever member with respect to the base member; and the pivoting end of the longitudinal lever member is also provided with a cross section that defines a variable transverse gap between the members at their pivotable end, with a maximal transverse gap occurring when the lever member forms an obtuse angle up to 180°, and with a minimal transverse gap occurring when the lever member reaches a substantially vertical angle (acute) down to zero degrees as effecting maximum tube compression.

Other objects, details and advantages of the present invention will become apparent from reading of the following specifications, claims and drawing wherein:

DETAILED DESCRIPTION OF PREFERRED EMBODIMENTS

Figures 2, 3, 3E, 3S, 4, 5, 5E, 5S, 6, 7, 8, 9:
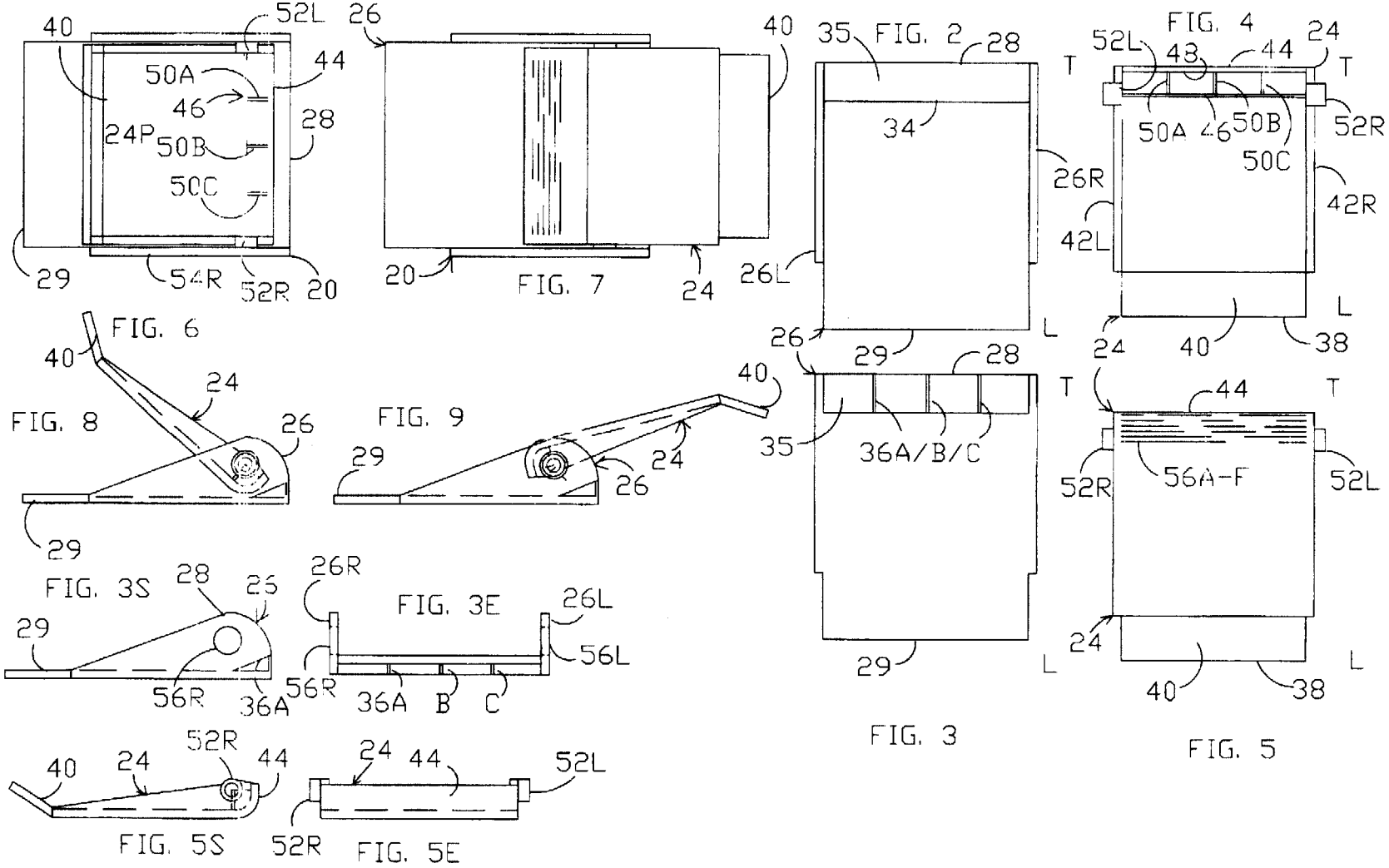
FIG. 2 is a top plan view of the isolated base member of the assembly of FIG. 1.
FIG. 3 is a bottom plan view of that base member.
FIG. 3S is a side elevational view of the base member of FIGS. 2 and 3.
FIG. 3E is an end elevational view of the base member of FIGS. 2 and 3.
FIG. 4 is a top plan view of the isolated lever member of the assembly of FIG. 1.
FIG. 5 is a bottom plan view of that lever member.
FIG. 5S is a side elevational view of the lever member of FIGS. 4/5.
FIG. 5E is an end elevational view of the lever member of FIGS. 4/5.
FIG. 6 is a top plan view of the conjoined members of FIGS. 2 and 3, with the lever member in the horizontal position.
FIG. 7 is a top plan view of the same assembly of FIG. 6 but with the lever member inclined upwardly.
FIG. 8 is a side elevational view of the closed angle assembly of FIG. 6.
FIG. 9 is a side elevational view of an acute angle for assembly of FIG. 7.

Referring now by numerical characters to the drawing, which illustrates two preferred embodiments of the present invention, there is presented a flowable materials dispensing device 20, exemplified by its use on a common toothpaste tube 22. The tube is already partially expressed, while being emptied in a uniform manner, by the digital manipulation of the depicted article. Device 20 comprises an uppermost, generally planar, rigid member 24, and an underlying (and enclosing) base member 26, which members are in pivotable cooperation at their one (trailing) longitudinal end 28, with that arcuate segment, serving as a channel for spent tube takeup. It will be apparent that by applying only modest digital pressure on planar surface 24P of lever 24, that such will create a smooth expression of the flowable contents (not seen) of capped tube 22, once it is uncapped (not seen). Leading segment 30 of upper member 24 is sloped upwardly to form a flared angle (FIG. 5S). Trailing edge 28 has an offset transverse ridge 32, which is spanned by three upstanding ridges. These integral ridges confer dimensional stability on the compression undersurface (not seen) at the pivoting axis 31.

The detailed configuration of the two operating components can be seen in the plan views of FIGS. 2/3 and 4/5. In FIG. 2, is depicted a top plan view of base member 26 with its upstanding, parallel sidewalls 26L and 26R, which walls extend over most of the length of that base member. A transverse crease 34 is located proximal to the trailing edge 28, and defines the linear border of the inwardly sloped, trailing segment 35 of base member 26. The obverse side of member 26 is depicted in FIG. 3, in which, the underside trailing edge 28 has three upwardly projecting, integral reinforcing ribs 36A/B/C, of a length just spanning the underside of slope edge end segment 35.

In FIG. 4, is presented a top plan view of upper lever member 24. The leading transverse edge 38 has an upwardly sloped, planar segment 40, defining an acute angle with underlying member 26 (see FIG. 8) along with its parallel sidewalls 42L/R. These flared segments provide a diverging gap at the leading edges 29/38 of device 20, while it accommodates an engaged, but still partly filled, tube body like 22 (not seen).

Also, at the trailing edge 44 of lever member 24 is seen a transverse, cross rib 46, spaced apart from the arcuate trailing segment 48, which is further provided with three spaced-apart short ribs 50A/B/C, spanning the parallel, transversely-positioned ribs 44/46. These ribs serve to provide dimensional stability to this pivoting, trailing edge of the device. On a common linear axis, proximal to the trailing edge 44, are located two outwardly oriented projections, 52L/R lugs, preferably cylindrical, which serve as the pivoting axis for member 24, while it is functionally engaged with base member 26. This axis may be centered on transverse rib 46.

On the obverse side of lever member 24 (FIG. 5) is seen the underside of leading edge 38 and sloped segment 40. At the trailing edge 44 of member 24, there are several parallel, closely-spaced, transverse ridges 56A–F, (like serrations as on a knob) optionally included, which can then serve to facilitate the grasping and shifting rearwardly of an engaged tube (not shown) by the closing lever member 24.

When lever member 24 is pressure-fitted upon its lateral projections 52L and 52R, into a working engagement with base member 26, the top plan view of the device is that seen in FIG. 6; while an alternate lever position, top plan view of the same device, is that seen in FIG. 7. The side elevational view of FIG. 8 (lever flat-no tube in place) corresponds to the top plan view of FIG. 6, while the side elevational view of FIG. 9 (lever mostly upright to present a transverse gap (not seen) corresponds to the top plan view of FIG. 7.

FIGS. 3S and 3E are the side and elevational views of the base member 26 of FIGS. 2/3, the former showing sidewall port 56L, which receives one lateral projection 52R of the lever member 24. In FIG. 2S, the tapering sidewall 26R, presents its maximal height proximal at its take-up end 28, which point presents the support port 56R for the projecting lug 52R of member 24. Similarly so, sidewall 26L of member 26 cooperates with the lever opposing sidewall 42L, and its other end lug 52L.

FIGS. 5S and 5E are the side and end views of the lever member 24, respectively, depicting the upward ledge 40 of the leading edge 38, and the one side, lateral projection 52R, which engages the port 56L of the base member. Projection 52R engages port 56R on the opposite side, so that both provide a pivotal axis for the squeezing device 20.

Depending upon the swingable position of lever 24, the substantial variation in the transverse gap between the conjoined member is well depicted in FIGS. 8 and 9. In FIG. 8, the acute angle of the lever member 24 provides the minimal transverse gap, while in FIG. 9, the lever member 24 (obtuse angle) now provides the maximal transverse gap. Like variations in transverse gaps are obtained with the members of the embodiment of FIG. 10M.

In a preferred embodiment, both members would be fabricated from an engineering plastic, such as an ABS thermosetting resin, which needs to display manual flexibility. The flanges need limited resilient flexing, so as to allow base member assembly (by snap-fit) with lever member 24.

Figure 1:
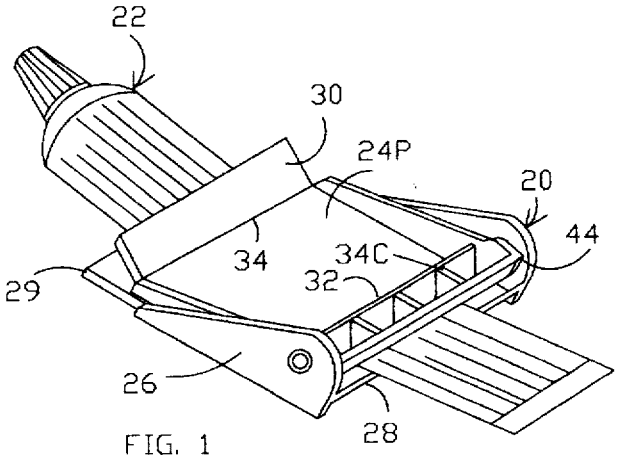
FIG. 1 is a perspective view of the formed rigid plastic dispensing device of the present invention having a toothpaste tube being digitally compressed to effect controlled dispensing of the highly flowable, contained dentifrice.
Figure 1P:
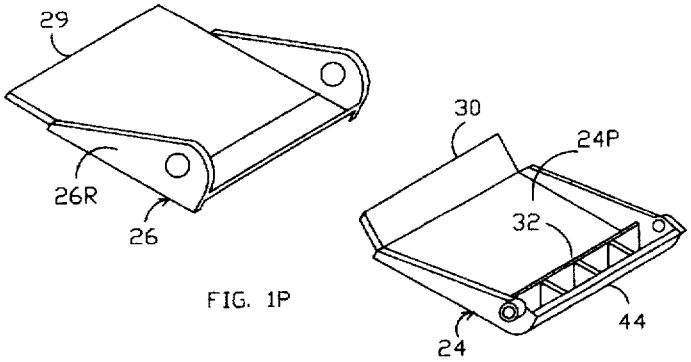
FIG. 1P is a perspective view of the same device, operative members spaced apart.

The embodiment of FIG. 1 is comprised efficiently and preferably of two formed plastic parts of selectively resilient materials to permit facile digital mating, and requiring no separate hinge pins or internal bars to effect its camming action on tubes.

Figure 10M:
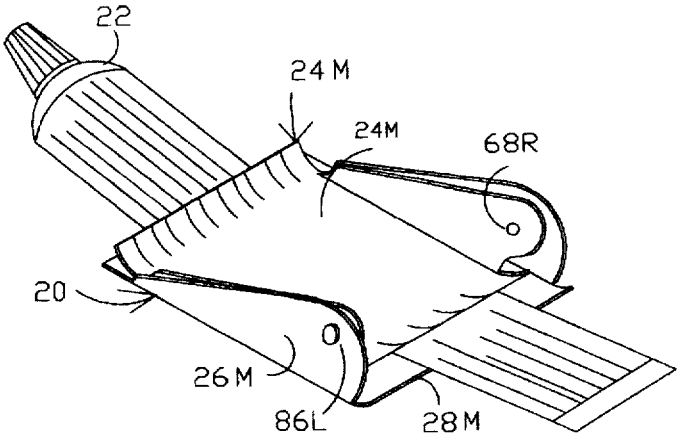
FIG. 10M is a perspective view of the heavy duty, rigid metal dispensing device of the present invention, also having a squeezeable tube being digitally compressed to effect controlled extraction of the flowable, but more viscous, contained caulking compound. It employs separable rivet pins, with both major components being fabricated from higher gauge sheet metal.
Figures 10B, 10L, 11B, 11L, 12B, 12L, 13B, 13L:
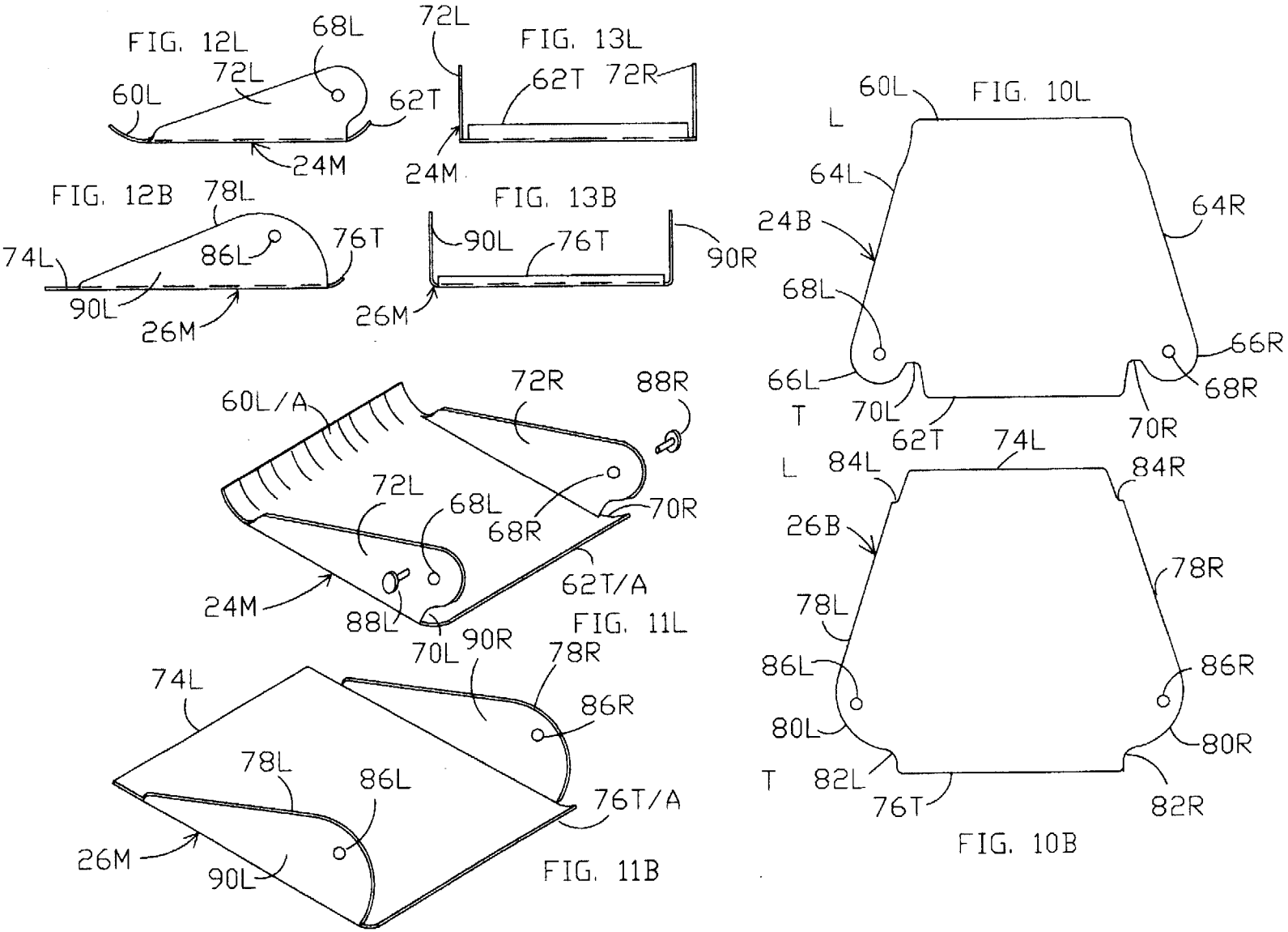
FIG. 10L is the planar metal blank for the lever member of the assembly of FIG. 10M, ready for metal bending to form the channeled lever member of FIG. 11L.
FIG. 10B is the planar metal blank for the base member of the assembly of FIG. 10M, ready for metal bending to form the channeled base member of FIG. 11B.
FIG. 11L is a perspective view of the fully-formed isolated lever member of FIG. 10L.
FIG. 11B is a perspective view of the fully-formed isolated base member of FIG. 10B.
FIGS. 12L and 12B are side elevational views of the fully-formed, isolated members of FIGS. 11L and 11B, respectively.

The planar member 24B of FIG. 10L depicts the one component configuration prior to its three dimensional forming into lever member 24M of the assembly 10M. The leading and trailing edges 60L and 62T are linear, while the lateral linear edges side walls 64L and 64R are tapered uniformly toward the leading edge 60L. The rounded end protrusions 66L and 66R of the trailing edge 62T are provided with bore holes 68L and 68R. The adjacent symmetrical indentations 70L and 70R, are needed to facilitate the slight flexing of the once-formed arcuate leading edge 62T during compressive use. After the required conforming of member 24B to the useful form 24M, it appears as seen in FIG. 11L, more clearly showing the transversely aligned, inwardly arcuate, presentation of the leading edge 60L, and the similar inwardly arcuate, presentation of the trailing edge 62T, along with the upstanding sidewalls 72L and 72R of that lever member.

In the side elevational view of FIG. 12L, the terminal end configurations of lever member 24M alone is further depicted. The trailing edge 62T view of FIG. 13L with upstanding sidewalls 72L/R completes the appearance of lever member 24.

The planar member 26B of FIG. 10B depicts the other component configuration prior to three dimensional forming into base member 26M of the assembly (FIG. 10M). The leading and trailing edges 74L and 76T are linear, while the lateral linear edges 78L and 78R also are tapered uniformly toward leading edge 74L. The rounded end protrusions 80L and 80R located proximal the trailing edge 76T, provide a smooth upright edge at that longitudinal end. The adjacent lateral indentations, 82L and 82R, defining the ends of trailing edge 76T, facilitate the forming of inwardly arcuate, trailing edge 76A of FIG. 11B; similarly so, with the slightly shouldered, longitudinal ends 84L and 84R at the leading edge 74L of the member 24M. The protrusions 80L/80R are provided with bore holes 86L and 86R to accept rivet pins 88L and 88R.

In the perspective view of FIG. 11B, the resulting configuration of the base member 26M is apparent, with its upstanding sidewalls 90L and 90R, also presenting the anchor ports 86L and 86R, for receiving the rivet-type pivot pins 88L and 88R.

In the side elevational view of FIG. 12B, the sidewall 88L configuration is shown, including the port 86L for inserting the rivet 88R, as depicted in FIG. 11L. The trailing edge view of FIG. 13B completes the appearance of the base member 26M. As noted earlier, the conjoined members 24M and 26M appear as seen in FIG. 10M, when the rivet pins 88L and 88R have been inserted, and are then capped at their inner open ends after mounting, for repeated and extended operation.

As to the metallic embodiment of FIG. 10M, the rivet-type pivot pins can be replaced functionally by a separable rigid rod (not shown) which spans and traverses both pairs of adjacent flanges through their bore holes with the in situ rod being modified at each longitudinal end to retain its operative position by flanging.

The metallic version is constructed from differing cut forms of planar blanks of 20 gauge stainless steel sheet. Such structural strength is needed with the dispensing of more viscous materials, like caulking resins. When forming the lever member, each of the transverse linear edges (leading and trailing) are provided with an inwardly oriented arcuate segment, the leading segment facilitates grasping of the lever member, while the trailing segment facilitates prying of the lever segment from compressive contact with the compressed tubular body.

With preferred use of stainless steel sheet, such element will have a slight spring-back action, upon release of digital compression, to return it to a posture similar to that depicted in FIG. 8S. Because of the slight spring-like deflection of the rearward arcuate edge 54S of lever member 24M, there need be only a minimal transverse gap clearance when the lever is in the substantially upright posture. The lever 24M needs to be pivoted outwardly to provide a transverse gap sufficient to slide in a fresh tube.

Figure 13I:
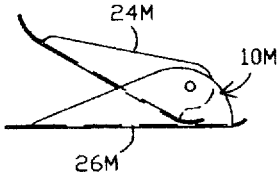
FIGS. 13L and 13B are end elevational views of the fully-formed members of FIGS. 12L and 12B, respectively; and, FIGS. 13I and 13U are alternate operating positions for a side elevational view of the assembled metal embodiment of FIG. 10M.
Figure 13U:
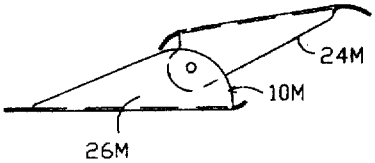

When the lever 24M is in the declining (inclined) posture (FIG. 13I), the minimal gap clearance, is adequate to digitally slide the contents-expended body of the compressed tube rearwardly with little effort. When lever 24M is in the substantially upright to obtuse angle position (FIG. 13U), the maximum gap clearance prevails, and the tubes can be inserted, removed or shifted longitudinally, as is required.

In the metal embodiment, the device mounting configuration allows for a variable transverse gap clearance between the base (channel) member and the lever member. This minimal gap clearance is set at 0.025", when the device is empty. Regarding the metal embodiment of FIG. 10M, when fully open (180°), the gap is ½" to allow entry of the tube, even a partially-used tube that has been hand squeezed and has many irregular corrugated deformations, with a closer gap and the spring action of stainless steel exerting greater pressure. These tube corrugations can be smoothed out, giving a fully depressed tube. This is a feature that sets the stainless steel version apart from the rest.

By way of typical dimensions for the lever member 24/5S (embodiment of FIG. 1), are the following: longitudinal length of 2.5", as measured from left-hand linear edge to the axis bearing lugs 34L and 34R; width of 2.27" including lugs; planar section thickness of 0.1"; radius of pivot axis to the periphery of its contacting surface: 0.35"; diameter of pivot pin 34L as seen in the alternate embodiment: 0.313"; and overall sidewall 50L height at the pivot axis: 0.663".

For the channeled base member 26 (FIG. 1/1P embodiment), typical dimensions are: overall length of 3.0" from left-hand linear edge to the axis center of the arcuate tapering sidewall 38L flange; width including upright sidewalls—2.5"; planar section thickness of 0.1"; radius of bore hole 32L center to leading edge 28 of member 26: 0.5"; overall height of flange over bore hole 32L axis: 0.745";

height of leading edge ramp 56; 0.25", and diameter of bore hole 32L for either lug 34L/R (or for an axial pin) engagement: 0.32".

The apparatus just described may be constructed of ceramic, wood, metal plate, or a rigid engineering plastic, preferably one of the latter two, so long as the material of fabrication has sufficient strength to perform its intended function repetitively. Evaluations show that certain fabrication plastics to be selected are well within the skill of the art; they will perform satisfactorily, whether squeezing the valuable flowable contents from either thick metal foil or formed plastic sheet, collapsible tubes.

In the alternate embodiment of FIG. 10M, metal plate (ideally stainless steel), and metal rivet pins are the materials of fabrication. The configuration of the channels and defining upright sidewalls (flanges) is substantially identical, but member wall thicknesses can be reduced substantially because of the greater strength of formed metal, to about 19–22 gauge.

To further explain the camming of lever member 24 action (FIG. 1 embodiment), it must be noted that when the presser lever is opened 180°, you will have the maximum opening of ½" to allow entering of the squeezeable tube. Upon closing the presser lever to slightly more than straight up, it will reduce the opening to its minimum set at a fixed 0.025", which is the double wall thickness of the fully compressed tube. This minimum gap will secure the tube, preventing material flowback, and is maintained (0.025" gap) by the rounded configuration of the presser lever.

In further explanation of the camming action, when presser lever is fully depressed, if one wishes to shift the tube for a new grip position, either presser lever will have to be raised beyond 90° to free the tube for movement. For proper function, the presser lever should be opened no more than is needed to allow the tube to be moved. By maintaining a close tolerance (transverse gap) while moving the tube, the material will move up in the tube while maintaining the tube fully compressed, before the presser lever is closed downward to secure the tube for further compression.

When it is desired to expel the contents from tube 22, the user, as with the use of a single hand, will apply pressure upon the forward planar surface 24P of member 24, and thus compress the tube within gap 52 (FIG. 6), so as to effect an advancement of the tube contents through tube neck, as above described. As the contents are thus expressed, the collapsed portion of tube 22 is moved rearwardly between the opposing member surfaces, so that a filled section of the tube 22 is located within the opposing member diverging surfaces (FIG. 9) for the next contents partial discharging operation.

From the foregoing description, it will be recognized by those skilled in the art, that various modifications and improvements of the described collapsible tube compressing device may be devised that are without departing from the scope of the described invention and the appended claims.

I claim:

1. A tube squeezing device adapted for efficient expelling of flowable contents of a collapsible tube and requiring only essentially single-hand manipulation comprising:

a. a first planar, generally rectangular rigid base member;

b. a first pair of laterally aligned, upstanding flanges, conjoined along opposing lateral edges of said base member defining a channel and each being a tapered from one longitudinal end to another longitudinal end;

c. a bore hole provided in each such flange forming a first set and defining ends of a horizontal and transverse phantom line drawn therebetween;

d. a second planar generally rectangular rigid presser lever member having a second pair of laterally aligned, upstanding flanges, along opposing lateral edges, and each flange being tapered from one longitudinal end to another longitudinal end, sized to nest freely between the first pair of lateral flanges and to move in overlying relationship to said base member;

e. a second set of bore holes with one provided in each flange of the second member opposing the first set;

f. a pair of pivot pins positioned transversely of and proximal to the one longitudinal end of said first and second pair of flanges, axially aligned, and adapted to engage the opposing bore holes, of said first and second pair of flanges said bore holes defining a transverse axis of pivoting for the lever member, serving to permit the reciprocating movement of said lever member at a pivoting end thereof with respect to said base member; and, g. the pivoting end of said longitudinal lever member is also provided with an cross section that defines a variable transverse gap between the members at the pivotable end with a maximal transverse gap occurring when the lever member forms an obtuse angle of 180° and with a minimal transverse gap occurring when the lever member reaches a substantially acute vertical angle of zero degrees thus providing maximum tube compression.

2. The device of claim 1 wherein a trailing transverse edge of the lever member has an inwardly arcuate presentation, which aids in tube insertion and retraction.

* * * * *